US007410387B2

(12) United States Patent
Howard et al.

(10) Patent No.: US 7,410,387 B2
(45) Date of Patent: Aug. 12, 2008

(54) STRAIN RELIEF FOR A FLAT FLEXIBLE CABLE

(75) Inventors: Patrick C. Howard, Austin, TX (US); Charles Mitchell, Austin, TX (US); Sywong Ngin, Austin, TX (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 11/538,723

(22) Filed: Oct. 4, 2006

(65) Prior Publication Data

US 2008/0085627 A1 Apr. 10, 2008

(51) Int. Cl.
*H01R 13/58* (2006.01)

(52) U.S. Cl. ..... 439/449; 439/926

(58) Field of Classification Search ..... 439/67, 439/449, 926

See application file for complete search history.

(56) References Cited

U.S. PATENT DOCUMENTS 4,975,068 A 12/1990 Squires
5,683,259 A 11/1997 Sato
5,924,875 A 7/1999 Tighe et al.
6,755,683 B2 * 6/2004 Roberts et al. ..... 439/496

FOREIGN PATENT DOCUMENTS

JP 5327159 A 12/1993

* cited by examiner

*Primary Examiner*—Javaid H. Nasri

(57) ABSTRACT

A flat flexible cable with electrical conductors is disclosed for use in a vehicle. One or more of the conductors is configured to be attached to an external electrical device at an attachment point. The cable includes a region free from electrical conductors and an aperture formed through the conductor free region. The aperture is configured to be engaged with a cable engagement member to secure the cable to the electrical device and provide strain relief to the attachment point. The flat flexible cable can include a plurality of conductor free regions and a plurality of apertures in each of the one or more conductor free regions.

18 Claims, 5 Drawing Sheets

STRAIN RELIEF FOR A FLAT FLEXIBLE CABLE

TECHNICAL FIELD

The present invention relates to flat flexible electrical cables as used in vehicular applications. More particularly, the present invention relates to a structure and a method of providing strain relief to electrical attachment points between flat flexible cables and electrical devices.

BACKGROUND

Vehicle electrical systems increasingly include flat flexible cable as a media for transmitting power and signals within the system. Cables of any type typically need strain relief in certain areas within the vehicle or at specific locations within the electronic system to prevent damage to the cable and/or any electrical connections between the cable and an electronic device. As an example, a cable or cables that provide multiple conductors for connection to an electrical or electronic module may require strain relief. Traditionally, providing strain relief for wires or cables attached to an electrical or electronic device involved clamping a strain relief device onto the body of the cable or cables.

SUMMARY

In one aspect, the invention relates to a flat flexible cable with electrical conductors for use in a vehicle. One or more of the conductors are configured to be attached to an electrical device at an attachment point. The flat flexible cable includes a conductor free region extending across a portion of the width of the cable that is free from electrical conductors with an aperture formed through the conductor free region. The aperture is configured to be engaged with a cable engagement member to secure the cable to the electrical device and provide strain relief to the attachment point. The conductor free region can be positioned centrally along the width of the cable, closer to one edge of the cable than to another, or along an edge of the cable. Alternatively, the flat flexible cable can include a plurality of conductor free regions and/or a plurality of apertures in each of the one or more conductor free regions.

Another aspect of the invention relates to a method of providing strain relief to an electrical connection between a flat flexible cable and an external device. The method includes providing a flat flexible cable having at least one electrical conductor. The electrical conductor includes an electrical terminal. The method also includes forming an aperture through the flat flexible cable in a portion of the cable free from the electrical conductor. The method further includes attaching the electrical terminal to an external device and providing a cable engagement member to engage the aperture and secure the flat flexible cable to the external device.

The above summary is not intended to describe each disclosed embodiment or every implementation of the present invention. The figures and detailed description that follow more particularly exemplify illustrative embodiments.

BRIEF DESCRIPTION OF THE DRAWINGS

The concepts presented herein will be further explained with reference to the attached figures, wherein like structure or system elements can be referred to by like reference numerals throughout the several views.

While the above-identified figures set forth several embodiments of the present invention, other embodiments are also contemplated, as noted herein. In all cases, concepts presented herein describe the invention by way of representation and not by limitation. It should be understood that numerous other modifications and embodiments can be devised by those skilled in the art which fall within the scope and spirit of the principles of this invention.

DETAILED DESCRIPTION

Figure 1:
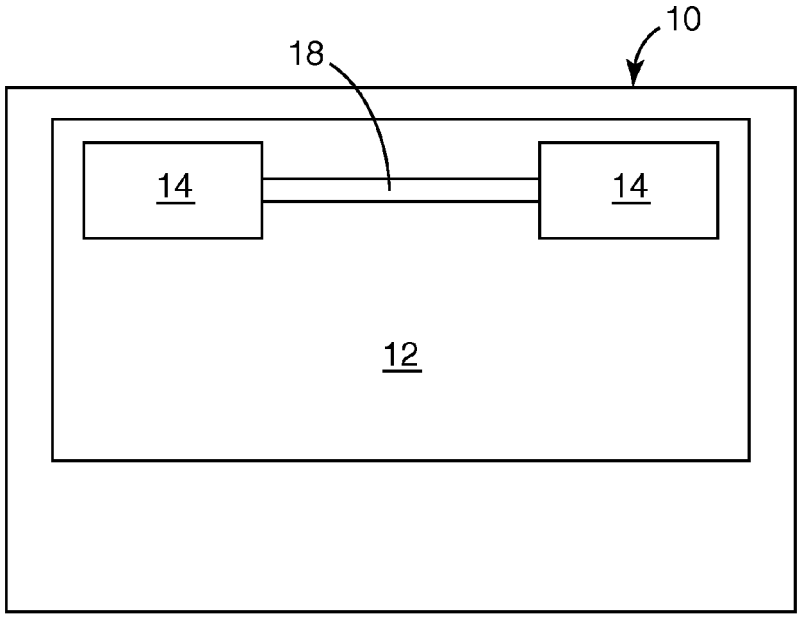
FIG. 1 is a block diagram of a vehicle including an electrical system with a link having conductors extending through it for providing electrical signals between electrical components within the electrical system of the vehicle.

FIG. 1 is a block diagram of a vehicle 10 such as an automobile or a truck having an electrical system 12. Electrical system 12 is shown having a pair of electrical devices 14. A link 18 having one or more electrical conductors is positioned between and attached to the electrical devices 14 to provide electrical communication between the electrical devices 14. Electrical devices 14 can be any electrical assembly including controllers, sensors, actuators and the like. FIG. 1 shows two electrical devices 14, but any number of devices can be included in the electrical system 12.

Figure 2A:
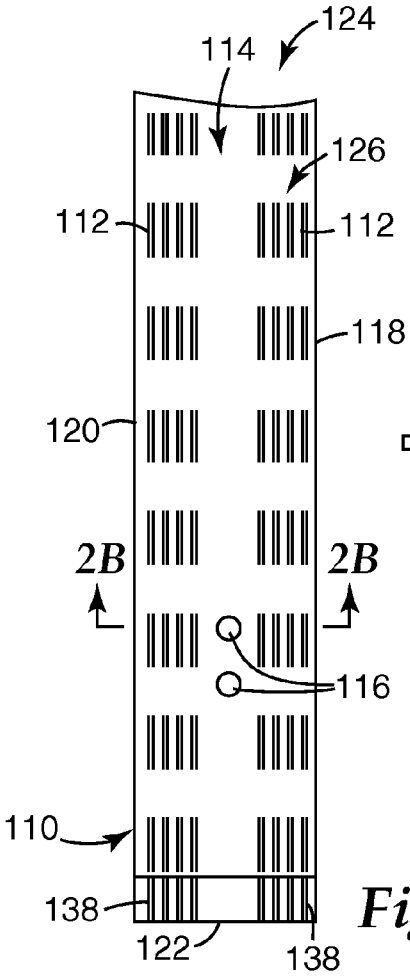
FIG. 2A is a schematic representation of a portion of a first embodiment of a flat flexible cable capable of providing the link shown FIG. 1 having a central portion of the width of the cable being a conductor free region that includes a structure configured to engage an external device to provide strain relief for the cable according to a first embodiment of the invention.
Figure 2B:
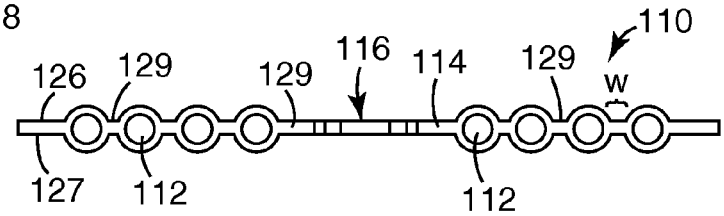
FIG. 2B is a sectional view as taken along line 2B-2B in FIG. 2A.

FIG. 2A is a schematic illustration of a portion of flat flexible cable 110 capable of being attached to an electrical device such as the electrical devices 14 shown in FIG. 1 to provide a link similar to that of link 18 according to one embodiment of the invention. FIG. 2B is a sectional view of the flat flexible cable shown in FIG. 2A. Flat flexible cable 110 has a width defined as the distance between a first edge 118 and second edge 120 of the flat flexible cable 110. The length of the flat flexible cable 110 runs from a first end 122 to a second end 124. As the representation of flat flexible cable 110 in FIG. 2A is a fragmentary view of the flat flexible cable 110, it should be appreciated that the position of the second end 124 is provided for illustrative purposes only and that FIG. 2A does not show the actual second end of the flat flexible cable 110. Flat flexible cable 110 includes a plurality of electrical conductors 112 that are positioned to extend from the first end 122 to the second end 124.

Flat flexible cable 110 includes a first major surface 126 and a second major surface 127 opposing the first major surface 126. An insulative material 129 made of, for example, a dielectric polymer, extends along each of the first and second major surfaces 126 and 127. The conductors 112 are positioned between the first and second major surfaces 126 and 127 and are shown in dashed lines in FIG. 2A to represent their positioning. The conductors 112 of flat flexible cable 110 extend to terminals 138 on the first end 122 of flat flexible cable 110. The terminals 138 on the first end 122 are uncovered by insulative material 129 that would normally cover the conductors 112 along the first major surface 126 and are configured to be connected to an electrical device, such as one of the electrical devices 14, that is otherwise external to the flat flexible cable 110. The details of the electrical connection will be described in more detail below. The conductors 112 extend longitudinally along the flat flexible cable 110, are generally parallel, and are closely positioned with respect to each other, with only a minimal width W of dielectric material 129 of the type extending along the first and second major surfaces 126 and 127 disposed between the conductors 112 of the flat flexible cable 110. The conductors 112 are shown as having a circular cross section, but alternatively, they can have any cross section, including rectangular or nearly flat.

Flat flexible cable 110 also includes a conductor free region 114, which is shown as being positioned between a plurality of conductors 112 positioned on either side of the conductor free region 114. For the purposes of this specification, it should be appreciated that the minimal width W between two closely spaced conductors 112 does not constitute a "conductor free region." Rather, a conductor free region 114 is a portion of the width of the flat flexible cable 110 that is capable of having one or more apertures 116 (described below) extending therethrough of the size necessary to engage a strain relief structure to provide strain relief to the flat flexible cable 10 without impinging upon any of the conductors 112.

In one embodiment, conductor free region 114 includes a pair of apertures 116 that extend through the flat flexible cable 110 from the first major surface 126 through the second major surface 127. Apertures 116 are configured to engage with an external device to secure the flat flexible cable 110 to that device and provide strain relief to the flat flexible cable 110 and the connections between the flat flexible cable 110 and the electrical device. Although FIG. 2A shows two apertures 116, it is to be understood that any number of apertures may be located within the conductor free region 114.

Figure 5:
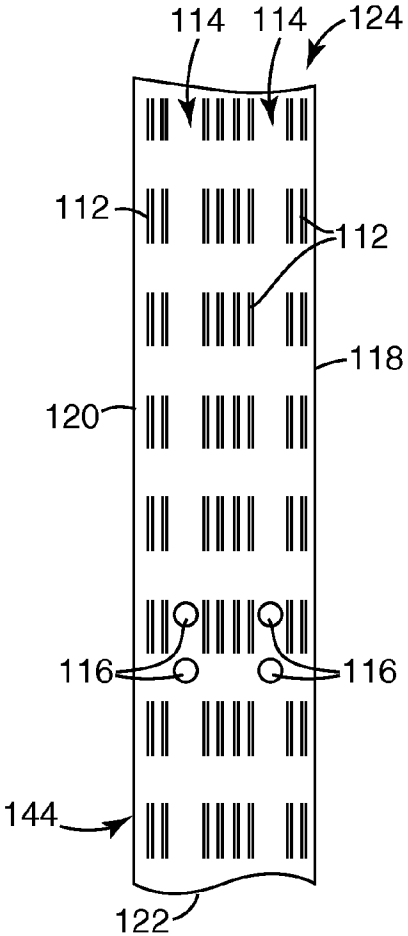
FIG. 5 is a schematic representation indicative of a fourth embodiment of a flat flexible cable of the type shown in FIG. 2A, having a plurality of conductor free regions.
Figure 4:
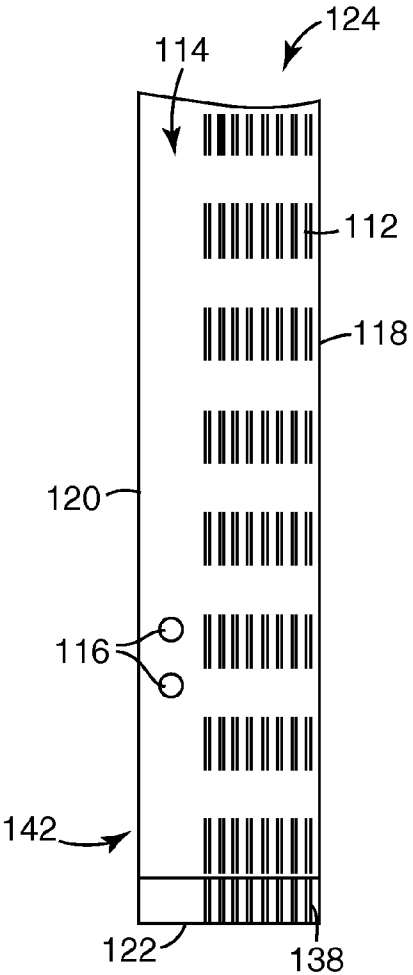
FIG. 4 is a schematic representation indicative of a portion of a third embodiment of a flat flexible cable of the type shown in FIG. 2A, having a conductor free region that includes a structure configured to engage an external device to provide strain relief for the cable positioned along one edge of the cable.
Figure 3:
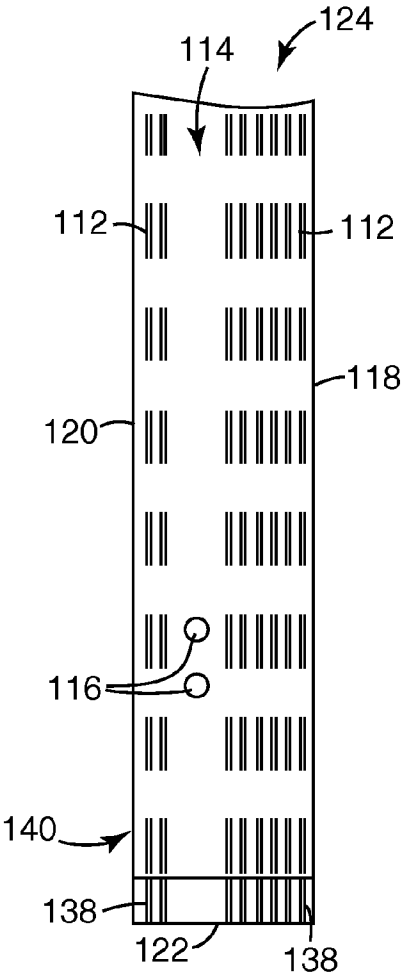
FIG. 3 is a schematic representation of a portion of a second embodiment of a flat flexible cable having conductors extending through it, with a portion of the width of the cable, offset from the center of the cable, being a conductor free region that includes a structure configured to engage an external device to provide strain relief for the cable according to a second embodiment of the invention.

FIGS. 3-5 illustrate alternative embodiments of flat flexible cables having conductor free regions 114 with apertures 116 extending therethrough positioned in various locations on their respective cables. For example, in FIG. 3, flat flexible cable 140 illustrates a conductor free region 114 so that it is closer to the second edge 120 of the flat flexible cable 140 than the first edge 118. Thus, a greater number of conductors 112 are positioned between the conductor free region 114 and the first edge 118 than are positioned between the conductor free region 114 and the second edge 120. Alternatively, of course, the conductor free region 114 can be positioned closer to the first edge 118 of the flat flexible cable 140 than the second edge 120.

FIG. 4 illustrates a flat flexible cable 142 having the conductor free region 114 positioned adjacent to the second edge 120 of the flat flexible cable. Thus, each of the conductors 112 disposed within the flat flexible cable 142 are positioned closer to the first edge 118 of the flat flexible cable 142 than is the conductor free region 114. Alternatively, of course, the conductor free region 114 can be positioned adjacent to the first edge 118 of the flat flexible cable 142.

In FIG. 5, flat flexible cable 144 includes a plurality of conductor free regions 114. A plurality of apertures 116 is shown extending through each of the conductor free regions 114. Conductors 112 are shown as being positioned between each of the conductor free regions 114. In addition, conductors 112 are illustrated as positioned between one of the conductor free regions 114 and the first edge 118 and the other of the conductor regions 114 and a second edge 120. Alternatively, either or both of the conductor free regions 114 can be placed adjacent to one of the first or second edges 118 or 120. Although two conductor free regions 114 are shown, it should be appreciated that any number of conductor free regions 114 can be positioned on a flat flexible cable such as flat flexible cable 144, each of which contains at least one aperture 116 extending through the conductor free region 114.

Figure 6:
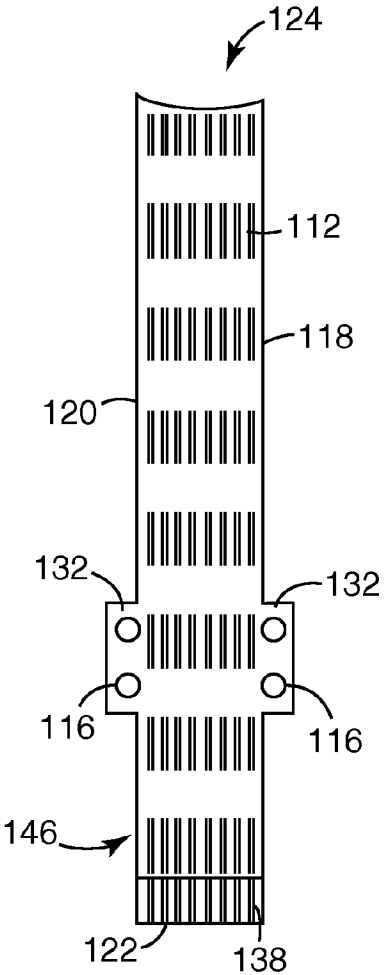
FIG. 6 is a schematic representation a fifth embodiment of a flat flexible cable of the type shown in FIG. 2A, having a pair of conductor free regions extending from each of first and second edges of the cable that each include a structure configured to engage an external device to provide strain relief for the cable positioned along one edge of the cable.

FIG. 6 illustrates a flat flexible cable 146 according to yet another embodiment of the invention. Flat flexible cable 146 includes a plurality of conductors 112 extending from the first end 122 to the second end 124. In addition, flat flexible cable 146 includes a conductor free tab 132 extending from each of the first and second edges 118 and 120. A pair of apertures 116 extend through each of the conductor free tabs 132 and are capable of interfacing with an electrical device similar to the electrical devices 14 to secure the flat flexible cable 146 to provide strain relief to any attachment points between the flat flexible cable 146 and the electrical device. In this embodiment, the width of the flat flexible cable 146 is greater in the areas where the conductor free tabs 132 are positioned.

Although the flat flexible cable 146 illustrated in FIG. 6 includes a pair of conductor free tabs 132, each of which is positioned at approximately the same location along the length of the flat flexible cable 146, it is to be understood that either of the conductor free tabs 132 can be positioned anywhere along the length of the flat flexible cable 146. Further, the flat flexible cable 146 can include any number of conductor free tabs 132. For example, flat flexible cable 146 may include only one conductor free tab 132 extending from either of the first edge 118 or the second edge 120. Alternatively, one of the first and second edges 118 and 120 can include a plurality of conductor free tabs 132 extending therefrom such that the number of conductor free tabs 132 on the first edge 118 and 120 is different from the number on the second edge 120. Further, any number of apertures 116 may extend through any of the tabs 132. For example, flat flexible cable 146 can include a first tab 132 having one aperture 116 extending therethrough and a second tab 132 having two or more apertures 116 extending therethrough. Further still, tab 132, while shown as having aperture 116 generally aligned along the length of flat flexible cable 146, can have a plurality of apertures 116 that are aligned along the width of the tab 132. In fact, the positioning of the apertures 116 within any conductor free region 114 of any of the embodiments is not limited by any of the embodiments shown herein.

Figure 7:
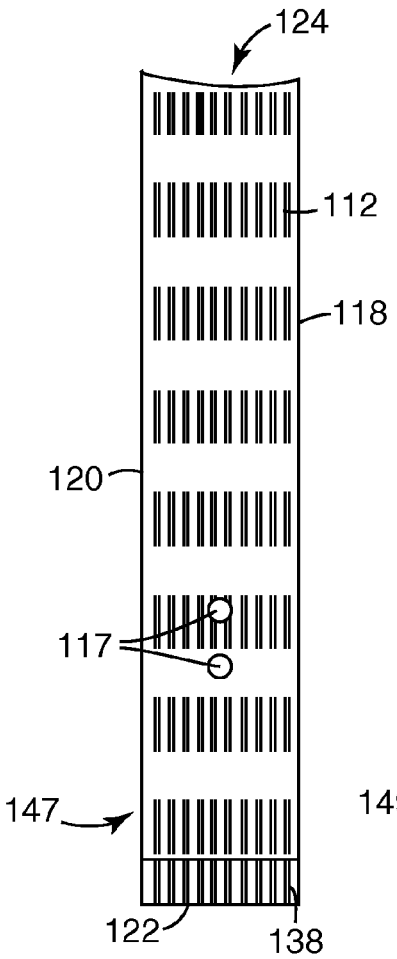
FIG. 7 is a schematic representation a sixth embodiment of a flat flexible cable of the type shown in FIG. 2A, having at least one aperture extending through a plurality of conductors aligned along the length of the flat flexible cable.

FIG. 7 illustrates a flat flexible cable 147 according to yet another embodiment of the invention. Flat flexible cable 147 does not include a conductor free region 114 as is shown in other embodiments. Instead, one or more apertures 117 extend through at least one of the conductors 112. The conductors 112 of flat flexible cable 147 that have apertures 117 extending through them do not have continuity from the first end 122 to the second end 124. Thus, the conductors 112 that have one or more apertures 117 formed through them are not typically connected to an external electrical device.

Figure 8A:
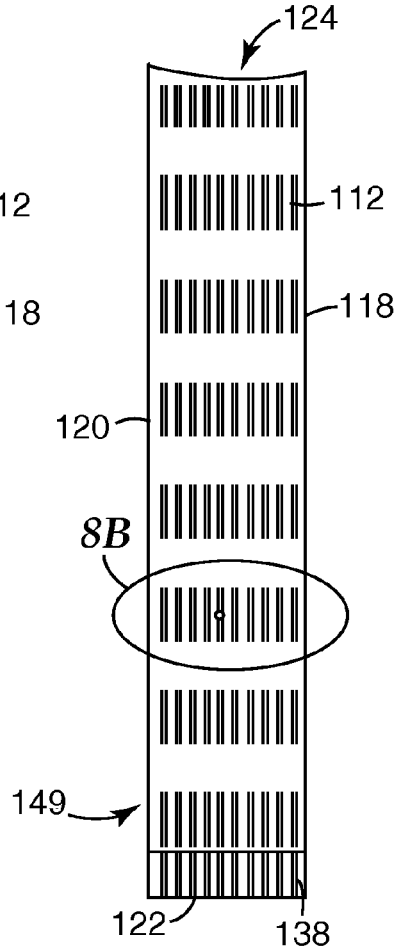
FIG. 8A is a schematic representation a seventh embodiment of a flat flexible cable of the type shown in FIG. 2A, having at least one aperture extending through a portion of one of the plurality of conductors aligned along the length of the flat flexible cable.
Figure 8B:
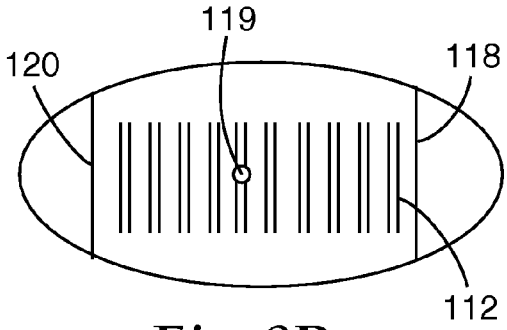
FIG. 8B is a detailed view of a portion of the flat flexible cable of FIG. 8A.

FIGS. 8A-8B illustrate a flat flexible cable 149 according to yet another embodiment of the invention. Like the flat flexible cable 147 of FIG. 7, flat flexible cable 149 does not include a conductor free region 114. Instead, one or more apertures 119 extend through one of the conductors 112 such that the conductor 112 through which the aperture 119 extends maintains its continuity from the first end 122 to the second end 124. In such a case, the conductor 112 that includes the aperture 119 can be connected to an external electrical device, although alternatively, the conductor 112 in question may remain unconnected.

Figure 9:
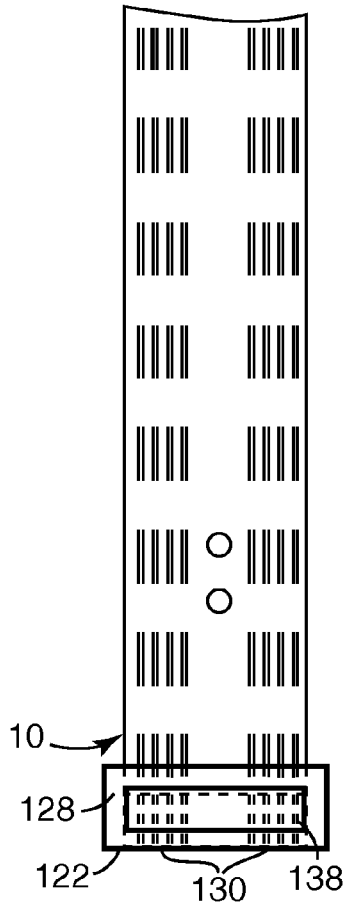
FIG. 9 illustrates the flat flexible cable of FIG. 2A, having a connector attached to one end of the cable.

As described above, the flat flexible cables are configured to be attached to an electrical device. In one embodiment, shown in FIG. 9, cable assembly 148 includes flat flexible cable 110 coupled to connector 128 at the first end of the flat flexible cable 10. Connector 128 includes a plurality of terminals 130, each of which is in electrical communication with one of the terminals 138 located at the first end 122 of the plurality of conductors 112. Connector 128 is configured to be attached to any device having a mating connector such as, for example, an electrical device having a circuit board with a mating connector attached thereto. While a single connector 128 is shown attached to the first end 122 of the flat flexible cable 10, it is to be understood that flat flexible cable 10 can have a second connector (not shown) attached to the second end 124 of flat flexible cable 10. Alternatively, the flat flexible cable 110 can be coupled to a circuit board so that terminals 138 are directly coupled to the circuit board without an intervening connector arrangement.

Figure 10:
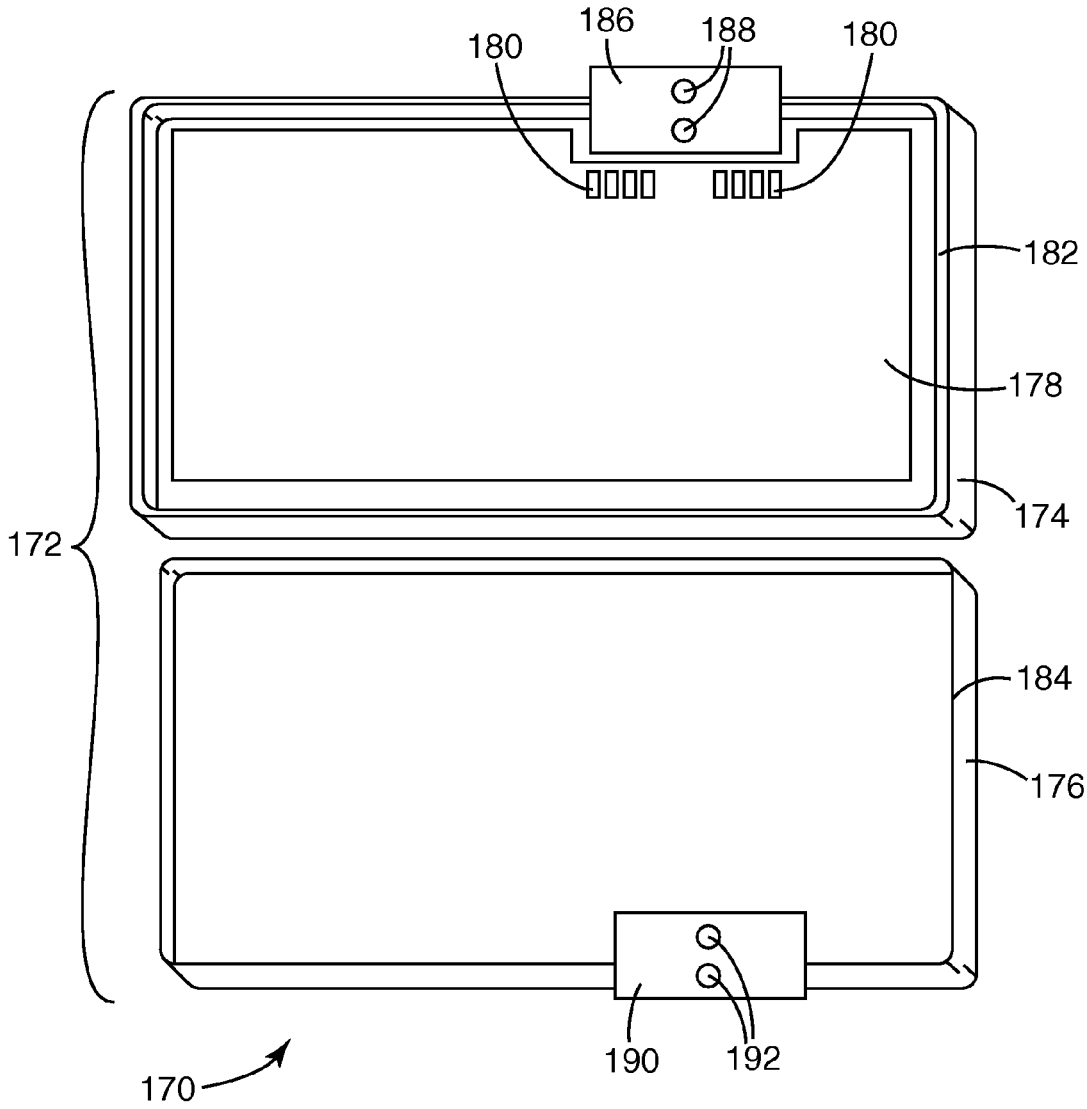
FIG. 10 illustrates a plan view of a portion of a housing for an electrical device having an interface with the structure located on the cable to provide strain relief and including a circuit board having a plurality of conductive pads configured to be attached to terminals of the type illustrated in FIG. 2A.

FIG. 10 illustrates an electrical device 170 configured to accept and be attached to the flat flexible cable 110. Electrical device 170 includes a housing 172 having first and second portions 174 and 176. A circuit board 178 is disposed within the first portion 174 of the housing 172 and has a plurality of conductors 180 capable of being attached to the terminals 138 on the first end 122 of the conductors 112 of cable 110. First and second portions 174 and 176 have mating surfaces 182 and 184 extending about an outer perimeter of the first and second portions 174 and 176, configured to engage each other when the first and second portions of the housing 172 are joined together. The mating surface 182 of the first portion 174 of housing 172 includes a generally planar first strain relief structure portion 186 having a pair of pegs 188 extending therefrom that are positioned to engage a flat flexible cable of the type described above. The pegs 188 are positioned such that they are configured to engage the flat flexible cable 110 shown in FIG. 2A. Of course, the arrangement of pegs 188 on the first strain relief structure portion 186 can be arranged to engage any of the embodiments of flat flexible cables described above or any other configuration that may be advantageous. The mating surface 184 of the second portion 176 of the housing 172 is includes a generally planar second strain relief structure portion 190 having a pair of recesses 192 positioned to engage the pegs 188 when the first and second portions 174 and 176 of the housing 172 are attached to each other. The cable interface plates 186 and 188 combine to engage and secure the flat flexible cable 110.

Figure 11A:
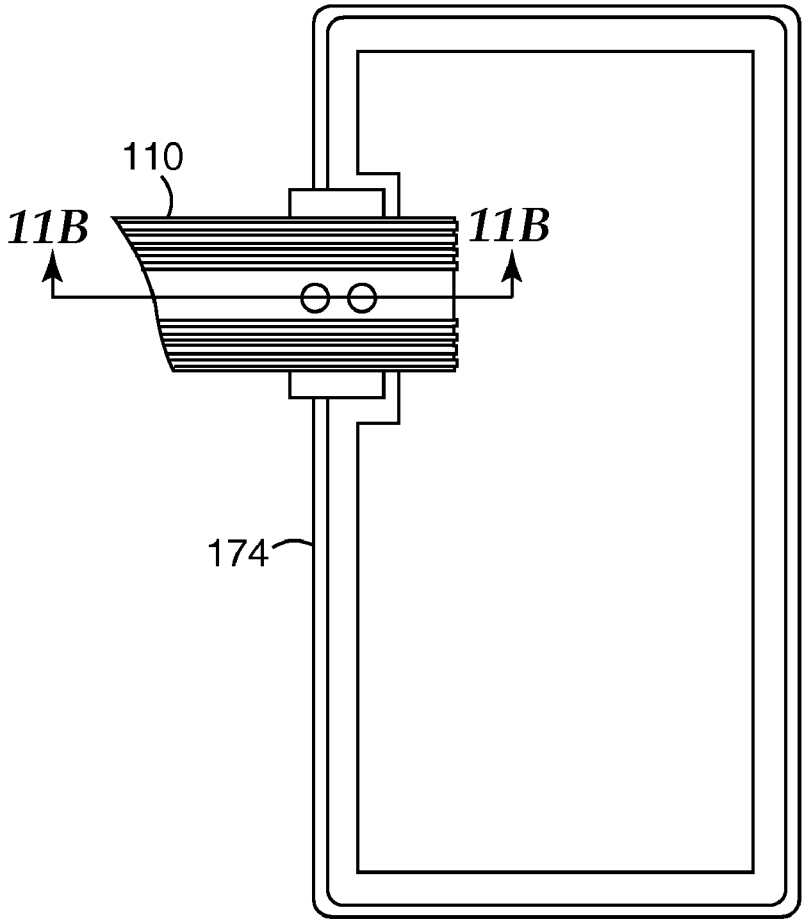
FIG. 11A illustrates the flat flexible cable of FIG. 2A attached to the circuit board located in a portion of the housing of FIG. 10.
Figure 11B:
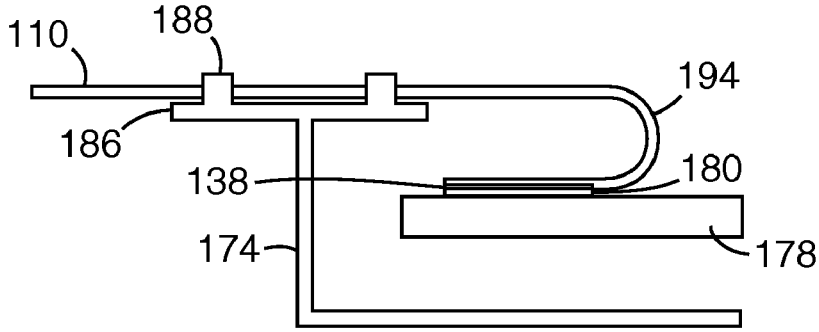
FIG. 11B is a fragmentary cross sectional view of the flat flexible cable attached to the housing taken along line 11B-11B in FIG. 11A.

FIGS. 11A-B illustrate flat flexible cable 110 having terminals 138 directly attached to the circuit board 178 at conductors 180. The terminals 138 of flat flexible cable 110 can be attached to the conductors 180 by soldering or other acceptable methods. The flat flexible cable 110 is then positioned so that the apertures 116 in the conductor free region 114 engage the pegs 188. The flat flexible cable is thus positioned and retained so that a certain amount of "play" exists in the cable, shown as a loop 194. Thus, strain on the attachment points between terminals 138 and the conductors 180 is relieved. When the second portion 176 of the housing 172 is positioned on the first portion 174 of the housing 172, the flat flexible cable 110 is captured.

FIGS. 11A-B illustrate one example of an interface between the apertures 116 of a flat flexible cable 110 and the housing 172. Other embodiments or examples are contemplated as well. For example, a housing for an electrical device may include a relief structure portion similar to that shown in FIGS. 11A-B. However, instead of a peg and receptacle arrangement in first and second relief structures, the relief structures may be adapted to accept one or more removable fasteners (not shown) to secure the relief structures together. The fasteners can also extend through apertures in the flat flexible cable to secure the flat flexible cable to the housing and provide strain relief. Other configurations of housings are similarly contemplated.

Given the embodiments described above, strain relief can be accomplished on a flat flexible cable to minimize potential damage to the flat flexible cable by the strain relief structure itself. In addition, strain relief can be provided in an efficient and cost-effective manner. As shown above, strain relief elements can be integrated into electronic housings for little or no added cost. Further, different embodiments of flat and flexible cables as of the type described above, can be adapted to a variety of different applications, as necessary.

Although the present invention has been described with reference to several alternative embodiments, workers skilled in the art will recognize that changes may be made in form and detail without departing from the spirit and the scope of the invention.

What is claimed is:

1. A flexible electrical cable with a width, which extends from a first edge to a second edge and a length, which extends from a first end to a second end, the flexible electrical cable having first and second major surfaces that extend along its width and length, the flexible electrical cable comprising:

a first layer extending along the first major surface and including a sheet of dielectric material;

a second layer extending along the second major surface and including a sheet of dielectric material;

a plurality of electrical conductors each having a first and second end, wherein at least a portion of each of the plurality of electrical conductors are positioned between the first layer and the second layer and extend substantially along the length of the flexible electrical cable and wherein at least one electrical conductor is configured to be fixedly attached to an electrical component at an attachment point proximal to the first end of at least one electrical conductor; and a region including an aperture not located at the attachment point proximal to the first end of the at least one electrical connector and extending through the flexible electrical cable from the first major surface to the second major surface, wherein the region extends along at least a portion of the length of the flexible electrical cable, wherein the region is free from electrical conductors and wherein the aperture is capable of interfacing with a cable engagement member to secure the flexible electrical cable to an external member located at a point separate from the attachment point with the electrical component and provide strain relief to the attachment point.

2. The flexible electrical cable of claim 1, wherein the region extends from the first end to the second end of the flexible electrical cable.

3. The flexible electrical cable of claim 1, wherein at least one conductor from the plurality of electrical conductors is positioned between the region and the first edge and at least one conductor of the plurality of electrical conductors is positioned between the region and the second edge.

4. The flexible electrical cable of claim 3, wherein the region is positioned approximately centrally between the first edge and the second edge.

5. The flexible electrical cable of claim 3, wherein the region is positioned closer to the first edge than the second edge.

6. The flexible electrical cable of claim 1, wherein the region is positioned adjacent the first edge and each of the plurality of electrical conductors is positioned between the region and the second edge.

7. The flexible electrical cable of claim 1, further comprising a second aperture extending through the flexible electrical cable.

8. The flexible electrical cable of claim 7, wherein the second aperture is positioned at substantially the same position as the first-mentioned aperture with respect to the width of the flexible electrical cable.

9. The flexible electrical cable of claim 7, wherein the second aperture is positioned at substantially the same position as the first-mentioned aperture with respect to the length of the flexible electrical cable.

10. The flexible electrical cable of claim 7, further comprising a second region, wherein the second region is free from electrical conductors and extends along at least a portion of the length of the flexible electrical cable, and wherein the second aperture is positioned within the second region and wherein the second aperture is capable of interfacing with a cable engagement member to secure the flexible electrical cable to an external member and provide strain relief to the attachment point.

11. The flexible electrical cable of claim 10, wherein the first-mentioned region does not extend from the first end to the second end, wherein the flexible electrical cable is wider along a length of the first-mentioned region than in other portions of the flexible electrical cable, wherein the second region is positioned at approximately the same distance from the first end of the cable as the first-mentioned region, and wherein each of the plurality of electrical conductors are positioned between the first-mentioned region and the second region.

12. The flexible electrical cable of claim 1, wherein the electrical component is a circuit board.

13. The flexible electrical cable of claim 1, wherein the cable engagement member is a fastener capable of extending through the first aperture and engaging the external member to secure the flexible electrical cable to an external member.

14. An electrical system for a vehicle comprising the flexible electrical cable of claim 1.

15. The electrical system of claim 14, further comprising an electronic control unit having a housing and a circuit board attached to the housing, wherein the at least one conductor is attached to the circuit board at the attachment point.

16. The electrical system of claim 14, wherein the cable engagement member is attached to at least a portion of the housing.

17. The electrical system of claim 14, wherein the cable engagement member includes a protrusion extending from at least a portion of the housing and wherein the flexible electrical cable is positioned so that the protrusion is capable of extending through the aperture.

18. The electrical system of claim 17, wherein the housing includes a first portion and a second portion, wherein the protrusion extends from the first portion, and wherein the second portion includes a protrusion mating member so that when the housing is assembled, the protrusion and the protrusion mating member engage to secure the cable to the housing.

* * * * *

UNITED STATES PATENT AND TRADEMARK OFFICE

CERTIFICATE OF CORRECTION

PATENT NO. : 7,410,387 B2
APPLICATION NO. : 11/538723
DATED : August 12, 2008
INVENTOR(S) : Patrick C. Howard It is certified that error appears in the above-identified patent and that said Letters Patent is hereby corrected as shown below:

Column 6,
Line 13, delete "is"

Signed and Sealed this

Seventeenth Day of February, 2009

JOHN DOLL
*Acting Director of the United States Patent and Trademark Office*